United States Patent [19]

Cohen

[11] 4,359,723

[45] Nov. 16, 1982

[54] PERSONAL MONITORING DEVICE

[76] Inventor: Ellis B. Cohen, 8 High Park Close, Mountnod, Coventry, England

[21] Appl. No.: 153,942

[22] Filed: May 28, 1980

[30] Foreign Application Priority Data

Jun. 2, 1979 [GB] United Kingdom ..... 7919307

[51] Int. Cl.[3] ..... G08B 21/00

[52] U.S. Cl. ..... 340/573; 340/529

[58] Field of Search ..... 340/573, 530, 529, 528; 200/61.52

[56] References Cited

U.S. PATENT DOCUMENTS

| | | | |
|---|---|---|---|
| 1,761,681 | 6/1930 | Reis, Jr. et al. | 200/61.52 |
| 4,110,741 | 8/1978 | Hubert et al. | 340/573 |
| 4,196,429 | 4/1980 | Davis | 340/573 |
| 4,234,876 | 11/1980 | Murai | 340/573 |

*Primary Examiner*—Glen R. Swann, III

*Attorney, Agent, or Firm*—Gerald J. Ferguson, Jr.; Joseph J. Baker

[57] ABSTRACT

A device for monitoring the physical activity of persons comprises a movement detector 8 electrically coupled to drive time-delay circuits [C2, R2, TR6, R6,][C4, R4, TR4, R5][C5, R7, TR8, R8,] the outputs of which are connected to drive an alarm device 10 such that in the presence of the movements detected by detector 8 the alarm device 10 is held in its OFF condition and is switched to its ON condition in the absence of such movements after a pertaining time-delay. The time-delay circuits are respectively arranged to provide time-delays of 30 seconds, 6 seconds, 40 seconds, with the first and second time-delay circuits being connected in series and the third time-delay circuit connected in parallel with the first two so that if the first timer circuit activates the alarm the second timer circuit provides a delay prior to latching of the alarm during which the alarm can be manually cancelled while the third timer circuit provides for fail-safe operation. The movement detector 8 comprises at least one tubular housing 5, containing a freely movable ball 5C and means for establishing an electrical output signal according to movement of the ball 5C or an acousto/electrical transducer or a mechanical/electric transducer. A pulse shaping and isolating circuit C1, R1 is located at the output of the detector 8 which provides pulses of predetermined amplitude and duration to the time-delay circuits within time intervals determined by the movement detector 8.

11 Claims, 4 Drawing Figures

PERSONAL MONITORING DEVICE

BACKGROUND OF THE INVENTION

This invention relates to a personal monitoring device arranged to provide an alarm signal in the absence of physical movements by the user of the device.

Various forms of such devices have been previously proposed, for example, as described in U.K. Pat. Nos. 919765, 1226478, 1514897 and 1547364 and U.S. Pat. Nos. 3,163,856, 3,614,763, 3,740,648 and 4,110,741 but these devices all suffer from the disadvantage that the basic transducer which senses the physical activity limits the usefulness of the device. For example some of these known transducers utilise a mercury switch whilst others utilise a pendulum switch both of which only function correctly, or at all, when orientated in a particular manner. U.K. Pat. No. 1514897 and U.S. Pat No. 4,110,741 both disclose a transducer in the form of a vibratory member carrying a piezo-resistant gauge which provides a continuously variable output without discrimination in relation to the source of vibration. Such discrimination is provided by a band-pass filter with a preset bandwidth.

The present invention is concerned with an improved form of device for monitoring physical activity of persons incorporating an improved form of transducer.

The invention is particularly useful to users involved in the fire and rescue services where hazardous areas are encountered so that in the event of a user becoming physically inactive, for example, due to becoming overpowered by noxious gases, an alarm signal will be emitted which can be detected by personnel outside the hazardous area who can thereby be warned to take action to assist the user of the device.

SUMMARY OF THE INVENTION

According to the present invention there is provided a device for monitoring the physical activity of persons comprising a movement detector electrically coupled to drive electrical time-delay means the output of which is connected to drive an alarm device the arrangement being such that the alarm device is held in its OFF condition in the presence of movements detected by the movement detector and is switched to its ON condition in the absence of such movements after a time-delay determined by said time-delay means, wherein said movement detector comprises at least one tubular housing with a cylindrical side wall closed with end caps and containing a freely movable ball and means operable according to movement of the ball within the housing to establish an electrical signal representative of the physical activity of a said person at an output terminal connected to the input of said time-delay means.

Preferably said movement detector comprises first and second mutually-perpendicular tubular housings each tubular housing having electrically conductive side walls electrically isolated from electrically conductive end caps and containing a freely movable electrically conductive ball for intermittently shorting the electrically conductive side walls to an electrically conductive end cap, the end caps of the first housing being electrically connected to the side wall of the second housing and the end caps of the second housing being connected together to form an input terminal for connection to a power supply, the side wall of the first housing forming said output terminal. It will be appreciated that the signal-establishing means in this case is an electrical circuit of which the conductive ball forms part. Alternatively, the signal establishing means may be a transducer mounted on the tubular housing, either an acousto/electric or mechanical/electric transducer.

Preferably also said time-delay means comprises first, second and third time-delay circuits respectively providing 30 seconds, 6 seconds and 40 seconds time-delays, the first and second time-delay circuits being connected in series, the inputs of the first and third time-delay circuits each being connected to the output terminal of the movement detector, the outputs of the first, second and third time-delay circuits each being connected to the input of the alarm device, the first and third time-delay circuit incorporating manually-operable ganged reset or cancellation circuits, the second time-delay circuit being non-cancellable, and the third time-delay circuit also including a key-operated reset or cancellation device.

It will be appreciated that with the preferred form of time-delay means operation of the alarm device effected by inactivity of the person whose activity is being monitored results after a 30 second period of inactivity after which there is a 6 second period during which the alarm device can be manually reset and failing which the 6 second time-delay circuit operates to latch the alarm device in the ON condition. The 40 second time-delay circuit acts as a fail-safe device to bring the alarm device to the ON condition in the event of failure of the 30 second time-delay circuit. Resetting of the 30 second time-delay circuit by manual action of the operator also resets the 40 second time-delay circuit. The alarm device can be shut down from the ON condition by means of the key-operated reset or cancellation device in the third time-delay circuit if a 40 second period of inactivity has elapsed.

Preferably also an alarm-check circuit is connected in parallel with the manually-operable reset or cancellation circuits. Conveniently the reset or cancellation circuits and the alarm check circuit are operated in common by a push-button switch, pulse operation of the push-button switch for a time interval of not more than 0.25 seconds actuating the reset or cancellation circuits and hold down operation of the push-button switch for a time interval of not less than 1 second actuating the alarm-check circuit.

BRIEF DESCRIPTION OF THE DRAWING

Embodiments of the present invention will now be described, by way of example, with reference to the accompanying drawing, in which.

DESCRIPTION OF THE PREFERRED EMBODIMENTS

Figure 1:
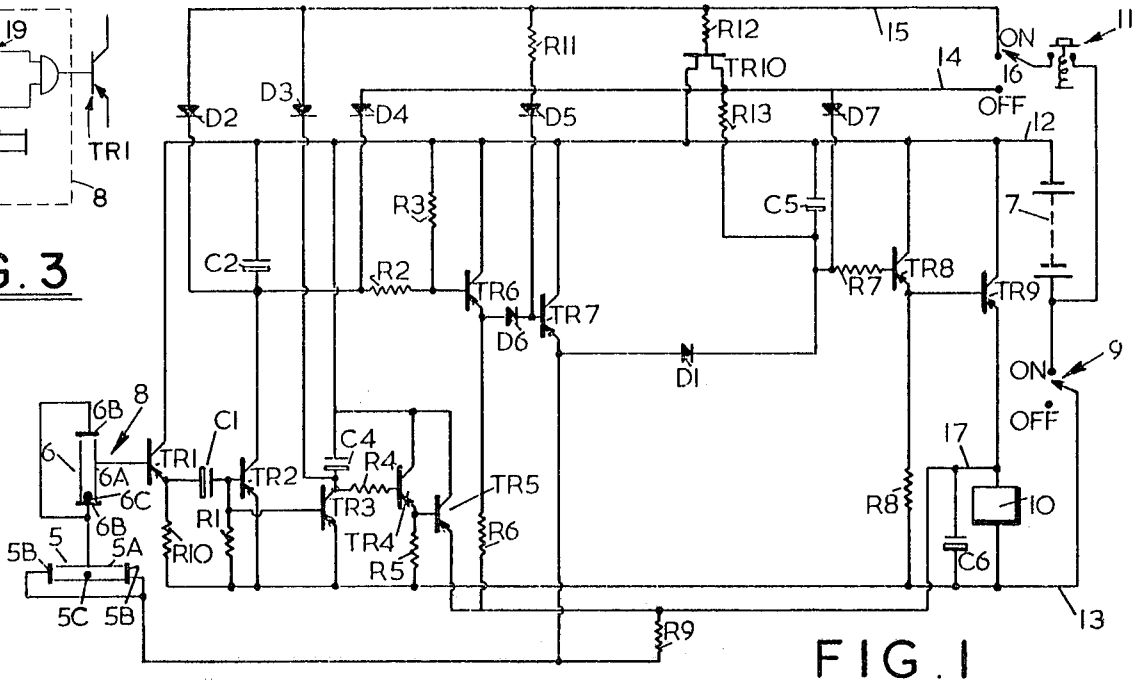
FIG. 1 is a circuit diagram of a device according to the present invention.

In the accompanying drawing a battery 7 is connected in series with a master ON/OFF switch 9 to provide d.c. supply voltages on leads 12 and 13. An alarm device 10 is connected in series with a transistor TR9 across leads 12, 13, the device 10 normally being held in an OFF condition by transistor TR9 being held off by a latching timer circuit as will be explained. A lead 17 provides an alternative way of switching on alarm device 10 and is fed from one or the other of two timer circuits as will be explained. Each of the timer circuits responds to the operation of a movement transducer or detector 8 and the arrangement is such that normal physical movement of the person whose activity is being monitored maintains the timer circuits so as to hold the alarm device 10 in the OFF condition.

In order to sense physical movements the device has a movement detector 8 which comprises two mutually perpendicular tubular housings 5,6 having electrically conductive side walls 5A,6A and electrically conductive end caps 5B,6B and containing an electrically-conductive sphere 5C,6C which is freely movable within the pertaining housing. The respective side walls and end caps are electrically isolated from each other, and shorting contact is achieved intermittently by spheres 5C,6C. The side wall of housing 6 forms an output terminal of the detector 8, the end caps 6B are both connected to the side wall 5A of housing 5 and the end caps 5B of housing 5 are connected together to form an input terminal of the detector 8.

The movement detector 8 has its output terminal connected to the base of amplifying transistor TR1 which supplies a pulse shaper and isolating circuit C1, R1, the output of which is fed in parallel to the base of transistors TR2, TR3. Transistor TR2 is connected to a first timer circuit which is formed by capacitor C2, resistor R2, transistor TR6 and resistor R6. Transistor TR3 is connected to a second timer circuit formed by capacitor C4, resistor R4, transistor TR4 and resistor R5. The first timer circuit has an output transistor switch TR7 which feeds line 17 through resistor R9. The second timer circuit has an output transistor switch TR5 which is directly connected to lead 17. Capacitor C6 is connected between lead 17 and the positive supply rail 13.

The output of transistor switch TR7 is connected through diode D1 to the input of a third timer circuit which is formed by capacitor C5, resistor R7, transistor TR8 and resistor R8. The emitter of transistor TR8 is connected to the base of transistor TR9.

The positive pole of battery 7, in addition to being connected to lead 13, is connected to a manually operable push switch 11 which is spring biased to its open or OFF position, the output of switch 11 being connected to a further switch 16 which is movable by means of a key or other security device between an ON position and an OFF position. In the ON position, which is its normal position, lead 15 is supplied with a positive voltage when switch 11 is closed. Lead 15 supplies through diodes D2 and D3 voltages to cause cancellation of the operation of the first and second timer circuits respectively as will be explained. Diode D5 and field effect transistor TR10, together with resistors R11, R12 and R13, form a rapid alarm check circuit which is connected in parallel with capacitor C5 so as to modify the discharge time constant for capacitor C5.

Switch 16 when moved to its OFF position causes the lead 14 to be provided with a positive voltage when switch 11 is closed whereby diodes D4 and D7 provide disabling signals.

The normal operation of the device shown in the accompanying drawing is as follows.

Figure 2:
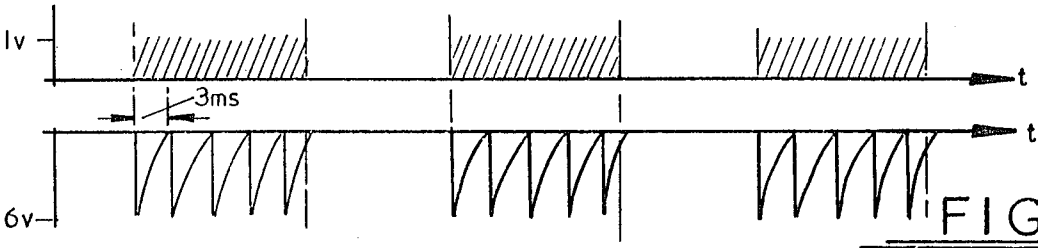
FIGS. 2A and 2B illustrate the signal waveforms at positions within FIG. 1.

Physical activity by the user of the device causes movement detector 8 to apply bursts of pulses of the shape shown in FIG. 2A to the base of transistor TR1 which acts as an amplifier to supply similarly shaped signals to the shaping and isolating circuit formed by 0.05 $\mu$F capacitor C1 and resistor R1. The signals appearing at the base of transistor TR2 are shaped approximately as shown in FIG. 2B and cause transistor TR2 (and transistor TR3) to switch on intermittently. Thus capacitor C2 intermittently receives charging pulses each of about 3 ms duration and is held in a charged state so that transistor TR6 is on, thereby applying a negative voltage to the base of transistor TR7, which is therefore off. Likewise capacitor C4 is normally in a charged condition, with transistor TR4 on and transistor TR5 off.

Because transistor TR7 is off capacitor C5 is normally charged having received a charging current via diode D1, resistor R9 and capacitor C6. Transistor TR8 is on and consequently TR9 is off.

Capacitor C2 has a discharge circuit with a 30 second time delay whereby on cessation of input signals to transistor TR1 from movement detector 8, transistor TR6 will switch off after a 30 second time interval. Resistor R3 is connected between base and collector of transistor TR6 to achieve a sharp switch off. Likewise capacitor C4 is connected to a 40-second discharge circuit, whereby after a time interval of 40 seconds from the cessation of output signals from movement detector 8, transistor TR4 switches off. Capacitor C5 is connected to a 6-second discharge circuit whereby transistor TR8 is switched off 6 seconds after the charging current through diode D1 to capacitor C5 is terminated.

When the user of the device is physically active, movement detector 8 produces a near continuous stream of pulses and each of the three timing circuits is correspondingly charged, leakage from each of these circuits being provided through the base emitter junction of the relevant transistors TR6, TR4 and TR8 each of which is in an ON condition. When physical activity of the user ceases, capacitors C2 and C4 immediately commence to discharge. Because capacitor C2 is in a 30 second timer circuit and capacitor C4 is in a 40 second timer circuit transistor TR6 switches off before transistor TR4. With transistor TR6 switched off a positive voltage is applied through diode D6 to the base of transistor TR7 which causes this transistor to switch on thereby applying an alarm ON signal to lead 17 through resistor R9. Simultaneously the charging current for capacitor C5 has been eliminated causing capacitor C5 to discharge, diode D1 preventing discharge through transistor TR7. Transistor TR8 switches off after a further 6 second time interval resulting in transistor TR9 switching on thereby applying an alarm on signal to the alarm device 10. The second timer circuit which contains capacitor C4 functions in a "fail-safe" mode whereby after 40 seconds from commencement of the inactivity transistor TR4 switches off causing transistor TR5 to switch on producing an alarm ON signal on lead 17.

When the user of the alarm is alert and the alarm device 10 first emits a warning signal resulting from an alarm ON signal from the first timer circuit, the user has a 6 second time interval within which to actuate push button switch 11. When this switch is closed for a short period, about 0.25 seconds, a positive voltage is applied through diodes D2 and D3 instantaneously to recharge capacitors C2 and C4 thereby cancelling the discharge of the first and third timer circuits with consequential reestablishment of the charging current for the second timer circuit. Non-alert behaviour of the user, whereby push switch 11 is held in its closed position for a longer period of time, about 1 second, results in transistor TR7 being switched on thereby eliminating the charging current from the second timer circuit and connection of resistor R13 in parallel with capacitor C5 so as to modify the second timer circuit to have a discharge time of only 1 second, as a result of which transistor TR8 is switched off causing transistor TR9 to switch on and alarm device 10 to emit a warning signal. There is no cancellation circuit associated with the second timer circuit so that after transistor TR8 has been switched off and transistor TR9 has been switched on it is not possible for the user to cancel the alarm. Such cancellation can only be effected by way of the key-operated switch 16 being moved to its OFF position whereafter the push-button 11 is pressed whereby diodes D4 and D7 provide instantaneous charging to capacitors C2 and C5 thereby resulting in the alarm device 10 being switched off.

It will be noted that when the alarm device 10 is switched on by the first charging circuit the supply current is fed through resistor R9. This results in a muted output from the alarm device 10 when the latter is an audio device. It will also be noted that when transistor TR7 is switched on the negative supply lead 12 is applied to the input of the movement detector 8. This results in negative going pulses being applied to the base of transistor 1 which prevents this transistor from switching. In normal operation the input to movement detector 8 is supplied with a positive voltage from the junction between resistor R9 and diode D1.

Figure 3:
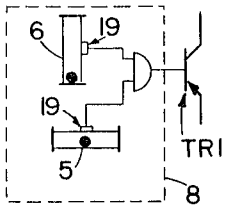
FIG. 3 illustrates an alternative form of a detail of FIG. 1.

The movement detector 8 may simply be a single tubular housing with a cylindrical side wall closed with end caps and containing a freely movable ball with means for establishing an electrical signal according to movement of the ball within the housing. This may be achieved by using a tubular housing as described with electrically-conductive portions which are intermittently bridged by the ball which is electrically-conductive for example by being made of steel. Alternatively the housing and ball may be non-electrically conductive and the signal-establishing means may take the form of a transducer 19 responsive either to an audio signal or a mechanical vibration signal established by the ball during its movement within the housing as indicated in FIG. 3. Thus the acousto/electric transducer may be a microphone secured to the exterior of the housing either at an end cap or on the cylindrical wall, or the mechanical-electrical transducer may be a piezoelectric transducer similarly located. In the event that only a single tubular housing is used to form the movement detector it is preferred that the longitudinal axis of the housing extend horizontally in normal use so that a persons normal backwards and forwards movements will maintain this orientation.

What is claimed is:

1. A device for monitoring the physical activity of persons comprising a movement detector electrically coupled to drive electrical time-delay means the output of which is connected to drive an alarm device the arrangement being such that the alarm device is held in its OFF condition in the presence of movements detected by the movement detector and is switched to its ON condition in the absence of such movements after a time delay determined by said time delay means, said movement detector comprising at least one tubular housing with a cylindrical side wall closed with end caps and containing a freely movable ball and means operable according to movement of the ball within the housing to establish an electrical signal representative of the physical activity of a said person at an output terminal connected to the input of said time-delay means, wherein said time-delay means comprises first and second time-delay circuits connected in series, the input of the first time-delay circuit being connected to the output terminal of the movement detector and the outputs of each of the first and second time-delay circuits being connected to the alarm device, said first time-delay circuit incorporating a manually-operable reset device and said second time-delay circuit being non-cancellable, the arrangement being such that if the first time-delay circuit activates the alarm the second time-delay circuit provides a time interval prior to its effecting latching of the alarm during which time interval the alarm can be manually cancelled by operation of said reset device, and said first time-delay circuit further includes means for automatically disabling the movement detector during the period that the first time-delay circuit produces a signal to turn on the alarm device.

2. A device as claimed in claim 1, wherein said movement detector comprises first and second mutually-perpendicular tubular housings each tubular housing having electrically conductive side walls electrically isolated from electrically conductive end caps and containing a freely movable electrically conductive ball for intermittently shorting the electrically conductive side walls to an electrically conductive end cap, the end caps of the first housing being electrically connected to the side wall of the second housing and the end caps of the second housing being connected together to form an input terminal for connection to a power supply, the side wall of the first housing forming said output terminal.

3. A device as claimed in claim 2, wherein said freely-movable electrically conductive ball is made of steel.

4. A device as claimed in claim 1, wherein said signal-establishing means is an acousto-electric transducer mounted on the tubular housing.

5. A device as claimed in claim 1, wherein said signal-establishing means is a mechanical-electrical transducer mounted on the tubular housing.

6. A device as claimed in claim 1, wherein said time-delay means further comprises a third time-delay circuit having its input connected to the output of the movement detector and its output connected to the input of the alarm device, said third time-delay circuit providing a time interval greater than the aggregate interval of the first and second time-delay circuits and including a manually-operable reset device ganged to the reset device of the first time-delay circuit and further including a key-operated cancellation device, the arrangement being such that the third time-delay circuit activates the alarm device in the event of failure of the first time-delay circuit.

7. A device as claimed in claim 6, wherein an alarm-check circuit is connected in parallel with said manually-operable reset devices.

8. A device as claimed in claim 7, wherein the reset devices and the alarm-check circuit are operated in common by a push-button switch, pulse operation of the push-button switch actuating the reset devices and hold down operation of the push-button switch actuating the alarm-check circuit.

9. A device as claimed in claim 6, wherein said first, second and third time-delay circuits respectively provide 30 seconds, 6 seconds and 40 seconds time intervals.

10. A device as claimed in claim 1, including a signal shaping and isolating circuit connected between the movement detector and the time-delay means.

11. A device as claimed in claim 10, wherein said signal shaping and isolating circuit provides pulses of predetermined amplitude and duration to said time-delay means within time intervals determined by said movement detector.

* * * * *